US012291826B2

(12) United States Patent
Bordelon et al.

(10) Patent No.: US 12,291,826 B2
(45) Date of Patent: May 6, 2025

(54) OVERLAPPING MODULAR MAT SYSTEM INCLUDING MAT COMPONENTS HAVING FORTIFYING MEMBERS

(71) Applicant: Newpark Mats & Integrated Services LLC, The Woodlands, TX (US)

(72) Inventors: Randy Paul Bordelon, Opelousas, LA (US); James Kerwin McDowell, Lafayette, LA (US); Gaurav Agrawal, The Woodlands, TX (US); Saad Aziz, The Woodlands, TX (US); Dane Manuel, The Woodlands, TX (US); Adam Marcel, The Woodlands, TX (US)

(73) Assignee: NEWPARK MATS & INTEGRATED SERVICES LLC, The Woodlands, TX (US)

( * ) Notice: Subject to any disclaimer, the term of this patent is extended or adjusted under 35 U.S.C. 154(b) by 720 days.

(21) Appl. No.: 17/434,493

(22) PCT Filed: Feb. 28, 2020

(86) PCT No.: PCT/US2020/020310
§ 371 (c)(1),
(2) Date: Aug. 27, 2021

(87) PCT Pub. No.: WO2020/176833
PCT Pub. Date: Sep. 3, 2020

(65) Prior Publication Data

US 2022/0136181 A1 May 5, 2022

Related U.S. Application Data

(60) Provisional application No. 62/811,878, filed on Feb. 28, 2019.

(51) Int. Cl.
*E01C 9/08* (2006.01)

(52) U.S. Cl.
CPC ..... *E01C 9/086* (2013.01)

(58) Field of Classification Search
CPC ..... E01C 9/086
(Continued)

(56) References Cited

U.S. PATENT DOCUMENTS 4,727,697 A * 3/1988 Vaux ..... E04F 15/22 428/116
5,888,612 A 3/1999 Needham et al.
(Continued)

FOREIGN PATENT DOCUMENTS

CN 105946298 A 9/2016
DE 9313243 U1 12/1993
(Continued)

OTHER PUBLICATIONS

CN Office Action; Application No. 202080031690.0; issued Nov. 14, 2022; 18 pages; Translation.
(Continued)

*Primary Examiner* — Raymond W Addie
(74) *Attorney, Agent, or Firm* — CANTOR COLBURN LLP

(57) ABSTRACT

A mat comprising a first side and a second side opposite the first side is disclosed. The mat has a body with a thickness defined between the first side and the second side and a width defined between a first edge and a second edge. A plurality of fortifying members can be positioned between the first side and the second side extend within the body substantially vertically with respect to the width. A lip can extend from the body of the mat and have a first rib having a first rib thickness. A first channel portion can have a first
(Continued)

channel thickness whereby the first rib thickness is greater than the first channel thickness.

20 Claims, 10 Drawing Sheets

(58) Field of Classification Search
USPC ..... 404/17, 18, 28–31, 34–36; 52/302.1, 52/588.1
See application file for complete search history.

(56) References Cited

U.S. PATENT DOCUMENTS

| | | | | |
|---|---|---|---|---|
| 8,936,374 | B1 * | 1/2015 | Royse | E01C 9/086 404/35 |
| 9,506,255 | B1 * | 11/2016 | Jones | E01C 9/086 |
| 2003/0113162 | A1 * | 6/2003 | Seaux | E01C 9/086 404/35 |
| 2004/0005430 | A1 | 1/2004 | Robers | |
| 2009/0016817 | A1 * | 1/2009 | Kulhawe | E04F 15/105 404/38 |
| 2011/0252730 | A1 | 10/2011 | Rosan | |
| 2012/0266549 | A1 * | 10/2012 | Rosan | E01C 5/22 52/173.1 |
| 2012/0304566 | A1 | 12/2012 | Thrush et al. | |
| 2013/0276399 | A1 * | 10/2013 | Rapaz | E01C 5/20 52/592.1 |
| 2018/0030667 | A1 * | 2/2018 | Penland, Jr. | B32B 3/06 |

FOREIGN PATENT DOCUMENTS

| | | | |
|---|---|---|---|
| GB | 2433539 | A | 6/2007 |
| WO | 0192638 | A1 | 12/2001 |

OTHER PUBLICATIONS

European Search Report for European Application No. 20762156.6; Date of Action: Mar. 1, 2023; 11 pages.
Partial Supplementary European Search Report for European Application No. 20762156.6; Date of Action: Nov. 25, 2022; 13 pages.
International Search Report, International Application No. PCT/US2020/020310, Date of Mailing Jul. 8, 2020; International Search Report 4 pages.
International Written Opinion, International Application No. PCT/US2020/020310, Date of Mailing Jul. 8, 2020; International Written Opinion 7 pages.

* cited by examiner

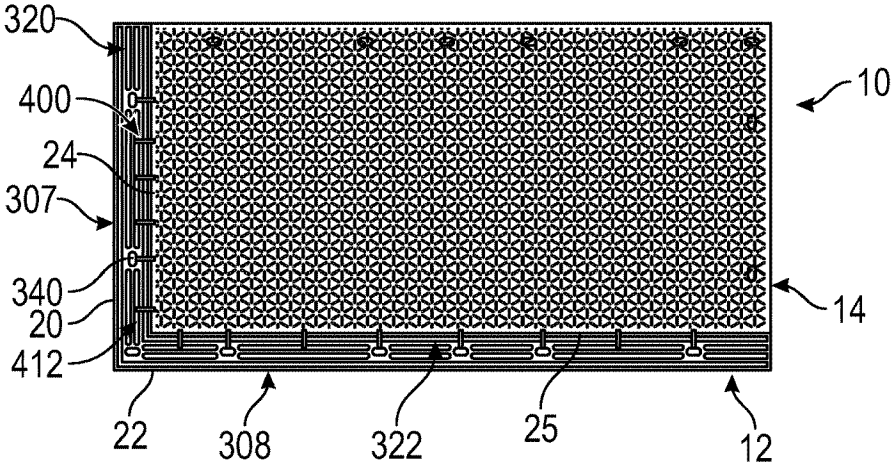
FIG. 14
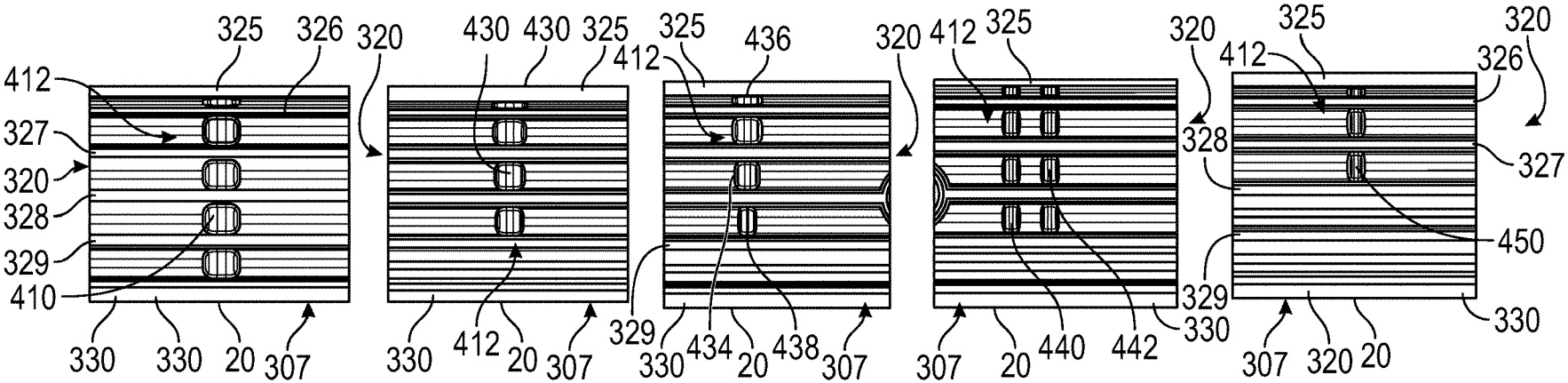
FIG. 15A
FIG. 15B
FIG. 15C
FIG. 15D
FIG. 15E

OVERLAPPING MODULAR MAT SYSTEM INCLUDING MAT COMPONENTS HAVING FORTIFYING MEMBERS

CROSS REFERENCE TO RELATED APPLICATIONS

This application is a National Stage application of PCT/US2020/020310, filed Feb. 28, 2020, which claims the benefit of U.S. Provisional Application No. 62/811,878, filed Feb. 28, 2019, both of which are incorporated by reference in their entirety herein.

BACKGROUND

When performing operations with heavy equipment in a remote location, it is often necessary to provide a firm, stable and continuous surface to support such heavy equipment. For example, when drilling a well in a remote location or installing electrical lines or support structure, it is often necessary to provide stable work surfaces. It is also advantageous to provide one or more roadways to permit ingress to and egress from said remote location. Such a surface must provide sufficient support for the equipment and personnel involved in the work process and must be able to withstand severe weather. Further, such a support surface must be capable of being quickly and easily installed, and thereafter being easily removed and reused at other locations.

Wooden boards or planks have historically been used to construct temporary roadways and equipment support surfaces in remote or undeveloped areas where the terrain lacks sufficient integrity to adequately support trucks and other heavy equipment. Such boards were generally placed end to end, or side by side, to form a continuous load supporting surface. While individual wooden boards or planks have been used to construct support surfaces for some time, this method of building roadways and other load bearing surfaces suffers from some very significant disadvantages.

Because such a large number of individual wooden boards are generally required to construct a typical roadway or equipment support surface, the use of wooden boards can be very labor intensive, since each board must first be individually positioned, and thereafter nailed or otherwise secured in place. Removal of said individual boards can also be a very time consuming and labor-intensive process, since each board must be separated or pulled apart prior to being removed from the location. Each individual board must also be loaded onto a truck or other means of transportation prior to being removed from the particular location or work site.

In order to overcome the aforementioned shortcomings associated with the use of individual boards, a variety of mat systems have been developed for the construction of temporary roadways and support surfaces. These mat systems typically utilize prefabricated, multi-layered wooden mats which can be installed in a variety of configurations to create roadways or other support surfaces. These mats, which are constructed of a number of individual boards or planks affixed together in a variety of configurations, generally interconnect or inter mesh with one another to form a continuous, or nearly continuous, support surface.

While such conventional mat systems may represent an improvement over the use of individual boards for the construction of roadways and other equipment support surfaces, the aforementioned conventional mat systems suffer from a number of serious shortcomings. Although such conventional mats may reduce labor requirements compared to individual wooden boards, significant amounts of time, effort and manpower are still required to install said mats at a remote location since most, if not all, of said conventional mat systems require the use of multiple layers. In other words, an initial layer must first be installed, then at least one additional layer of mats must be installed over said first layer. This multiple layer requirement leads to significant redundancy of effort in connection with both the installation and removal of said mats.

Conventional wooden mats also suffer from significant rotting problems, since the mats can become inundated with rainwater and various other contaminants from above, as well as mud from below. This mixture of water, mud and other contaminants will often invade into the seams or gaps between the boards of said mats, causing the wooden mats to rot from within. As a result, just as with individual boards, conventional mats must be frequently repaired and, in some cases, entirely replaced. Although conventional mat systems are designed to be reusable, the mats are still subject to significant repair and replacement expense. The design of these conventional mats can also lead to significant environmental problems, because mud and other contaminants can saturate the mats and collect within the numerous seams or gaps of said mats. Therefore, the industry desires a mat overcoming one or more of these disadvantages.

BRIEF DESCRIPTION OF THE DRAWINGS

The following descriptions are provided for reference and are not intended to limit the disclosure to only the embodiments shown.

FIG. 14 depicts a top view of a mat, in accordance with one or more embodiments of the present disclosure.

FIG. 15A depicts a section of a lip of the mat illustrating a lip stiffener, in accordance with one or more embodiments of the present disclosure.

FIG. 15B depicts a section of a lip of the mat illustrating a lip stiffener, in accordance with one or more embodiments of the present disclosure.

FIG. 15C depicts a section of a lip of the mat illustrating a lip stiffener, in accordance with one or more embodiments of the present disclosure.

FIG. 15D depicts a section of a lip of the mat illustrating a lip stiffener, in accordance with one or more embodiments of the present disclosure.

FIG. 15E depicts a section of a lip of the mat illustrating a lip stiffener, in accordance with one or more embodiments of the present disclosure.

DETAILED DESCRIPTION

Figure 1:
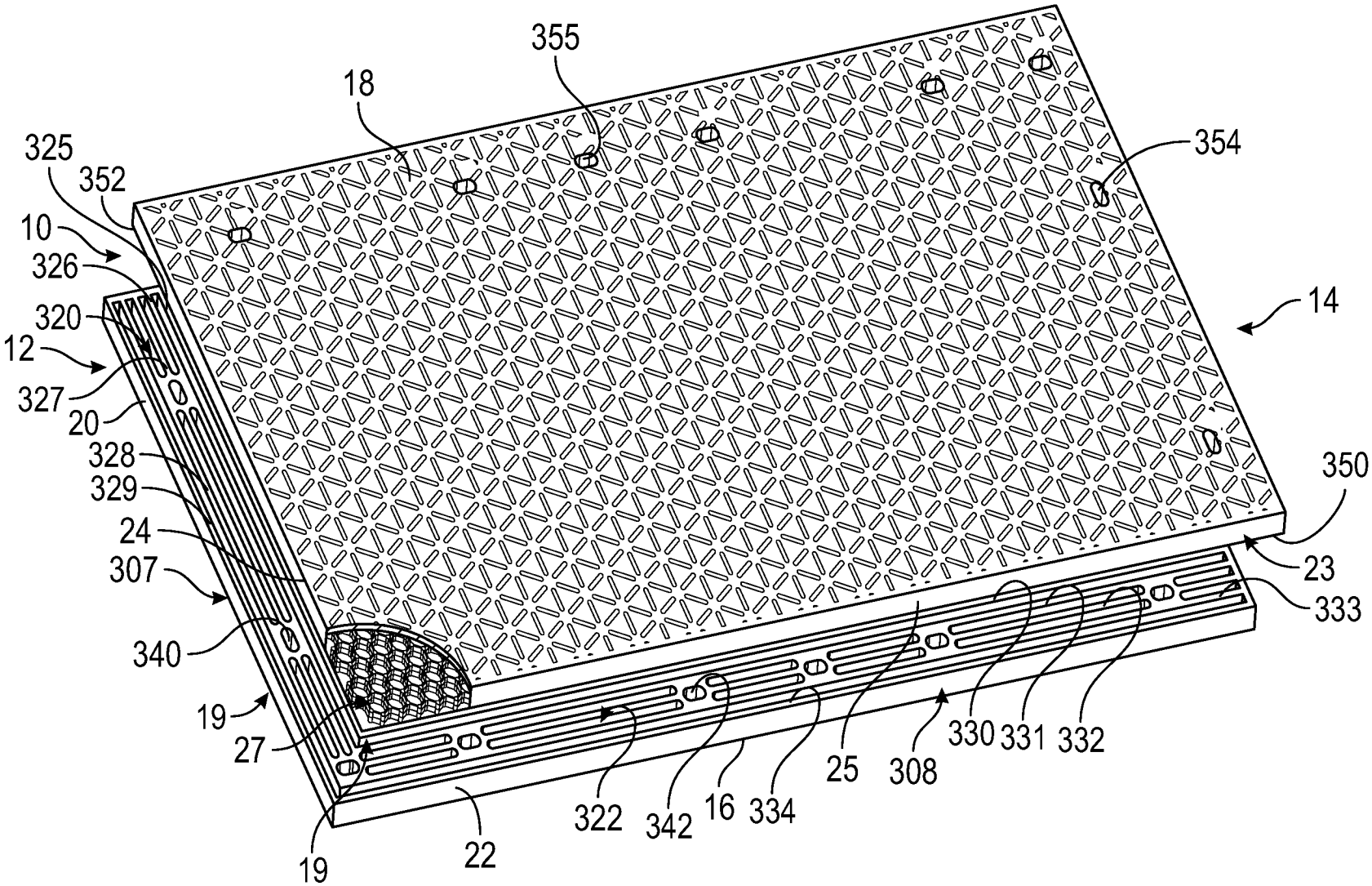
FIG. 1 depicts a mat with a partially cut-way view of a section of the mat, in accordance with one or more embodiments of the present disclosure.
Figure 2:
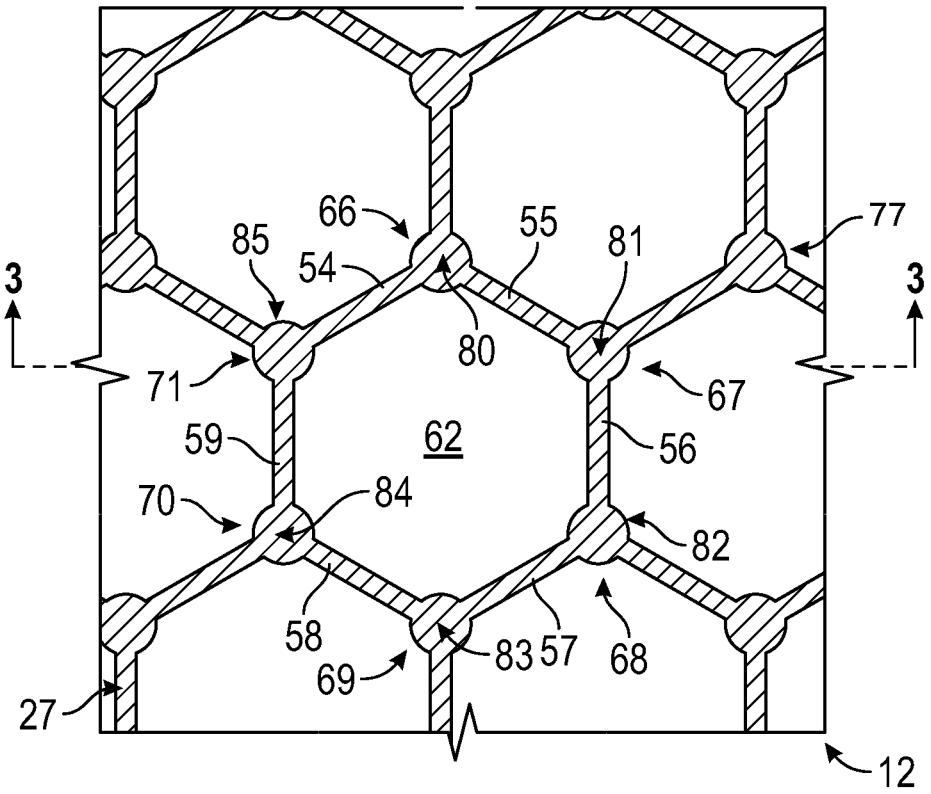
FIG. 2 depicts a partial plan view of the section of the mat illustrated in FIG. 1, in accordance with one or more embodiments of the present disclosure.

Characteristics and advantages of the present disclosure and additional features and benefits will be readily apparent to those skilled in the art upon consideration of the following detailed description of exemplary embodiments and/or referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of this disclosure and the appended claims. Many changes may be made to the particular embodiments and details disclosed herein without departing from such spirit and scope.

In showing and describing embodiments of the present disclosure in the appended figures, common or similar elements are referenced with like or identical reference numerals or are apparent from the figures and/or the description herein. The figures are not necessarily to scale, and certain features and certain views of the figures may be shown exaggerated in scale or in schematic in the interest of clarity and conciseness.

As used herein and throughout various portions (and headings) of this patent (including the claims), the terms "invention", "disclosure", "present invention", "present disclosure", and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference.

Certain terms are used herein and in the appended claims to refer to particular components. As one skilled in the art will appreciate, different persons may refer to a component by different names. Also, the terms "including" and "comprising" are used herein and in the appended claims in an open-ended fashion, and thus should be interpreted to mean "including, but not limited to . . . ". Further, reference herein and in the appended claims to components, feature, actions, aspects, etc. in a singular tense does not limit the present disclosure or appended claims to only one such component feature, action, aspect, etc., but should be interpreted to mean one or more, except and only to the extent as may be expressly limited otherwise herein or in a particular claim hereof and only for such claim(s) and any claim(s) depending therefrom As used herein and in the appended claims, the following terms have the following meanings, except and only to the extent as may be expressly specified differently in a particular claim hereof and only for such claim(s) and any claim(s) depending therefrom:

The term "and/or" as used herein provides for three distinct possibilities: one, the other or both. All three possibilities do not need to be available only any one of the three. For example, if a component is described as "having a collar and/or a sleeve", some embodiments may include a collar, some embodiments may include a sleeve and some embodiments may include both. Since the use of "and/or" herein does not require all three possibilities, a claim limitation herein that recites "having a collar and/or a sleeve" would be literally infringed by a device including only one or more collars, one or more sleeves or both one or more sleeves and one or more collars.

The terms "coupled", "connected" and the like, and variations thereof, as used herein mean either an indirect or direct connection or engagement, except and only to the extent as may be expressly recited and explicitly required in a particular claim hereof and only for such claim(s) and any claim(s) depending therefrom. Thus, if a first device couples to a second device, that connection may be through a direct connection, or through an indirect connection via other devices and connections, except and only to the extent as may be expressly recited and explicitly required otherwise herein or in a particular claim hereof and only for such claim(s) and any claim(s) depending therefrom.

The terms "elongated" and variations thereof as used herein mean, include and refer to an item having an overall length that is greater than its average width.

The terms "ground" and variations thereof mean the substrate, such as the earth's surface or other location (e.g. an underground location), any material(s), liquid (including waterways and bodies of water), other surface(s), structure(s), area(s), component(s) or a combination thereof, including indirect contact with the ground through an intermediate material, upon which a holding container is installed or erected.

The term "ground cover" is the name for and refers to a section of material that is useful to at least partially cover an area (on the ground or other surface), constructed of any desired material and capable of supporting a desired load.

The terms "load" and variations thereof mean, refer to and include any one or more among the pressure, forces, load, effective stress and weight bearing upon an item or component, such as, for example, the pressure, forces, load, effective stress, weight (or a combination thereof) of the contents of the storage area(s) bearing or acting upon one or more panels and/or support system of a holding container.

The terms "overlapping", and variations thereof mean that one of the referenced items rests upon and covers at least part of the other referenced item(s).

The terms "planar" and "flat", when used in reference to a panel, mean that the entirety of the panel generally extends in one or multiple parallel planes and the panel (or main body thereof) is substantially flat when originally constructed.

It should be noted that any of the above terms may be further explained, defined, expanded or limited below or in other sections of this patent. Further, the above list of terms is not all inclusive and other terms may be defined or explained below or in other sections of this patent.

A mat 10, as shown in FIG. 1, may be used to form part of a modular ground cover system. The mat 10 includes a first side 16 and a second side 18 opposite the first side 16. The mat 10 has body (not separately labeled) having a thickness defined between the first side 16 and the second side 18. Each of the first side 16 and the second side 18 may be substantially planar. The first side 16 can be integrally formed or secured and/or attached to the second side 18. In an embodiment, the mat 10 may comprise a first portion 12 and a second portion 14 that may be separable formed. In such an example, the first portion 12 and the second portion 14 can be secured and/or attached as will be detailed herein. The mat 10 may be made from a rigid material capable of withstanding compression forces, such as weights or other loads, positioned on the mat 10. For example, the mat 10 may be constructed of a thermoplastic polymeric material, such as polyethylene or alkathene. In accordance with an embodiment of the present disclosure, at least 60% of the first mat member 12 is formed from a polymeric material and at least 60% of the second portion 14 is formed from a polymeric material.

In an exemplary embodiment of the disclosure as shown in FIG. 1, the mat 10 includes peripheral edges 19 that define a perimeter of the first portion 12. The peripheral edges 19 include a first edge 20 and an adjacent second edge 22. The first edge 20 defines a width of first portion 12 and the second edge 22 defines a length of first portion 12. The first edge 20 and the second edge 22 are arranged substantially perpendicularly relative to one another. The peripheral edges 19 also includes a third edge (not separately labeled) that is parallel to the first edge 20 and a fourth edge (also not separately labeled) that is parallel to second edge 22.

Similarly, the second portion 14 includes a plurality of peripheral edge portions 23 that define a perimeter of second portion 14. The plurality of peripheral edge portions 23 include a first edge portion 24 and an adjacent second edge portion 25. The first edge portion 24 defines a width of second portion 14 while second edge portion 25 defines a length of second portion 14. First edge portion 24 is substantially perpendicular to the second edge portion 25. The peripheral edge portions 23 can include a third edge portion (not separately labeled) that is parallel to the first edge portion 24 and a fourth edge portion (also not separately labeled) that is parallel to second edge portion 25.

Interconnected web members 27 are formed and/or positioned between the first side 16 and the second side 18. In an embodiment, the interconnected web members 27 can be integrally formed with, coupled to and/or extend outwardly of the first portion 12 and/or the interconnected web member 270 may be formed with, coupled to and or/extend outwardly of the second portion 14. In an embodiment, the interconnected web members 27 can be formed with and/or integrally formed with the first portion 12 and the second portion 14. The plurality of interconnected web members 27 define voids 62 between the first side 16 and the second side 18. For example, the voids 62 within the interconnected web members 27 can establish that the mat 10 is at least 30% internally hollow. In an embodiment, each of the voids 62 may be between about 2.5" (6.35-cm) and about 5" cm) in diameter. In another embodiment, voids 62 may be about 5" in diameter.

The mat 10 may be formed by joining a first plurality of interconnected web members 27 that extend from first portion 12 with a second plurality of interconnected web members 270 (FIG. 10) that extend from second portion 14. In such an embodiment, the interconnected web members 27 of the first portion 12 can be mated with, molded to and/or otherwise attached to the interconnected web members 270 of the second portion 14.

Referring to FIGS. 2-5 the interconnected web members 27 can have portions or sections joined, integrally formed or otherwise attached in a shape to provide structural support for the mat 10. The interconnected web members 27 can define or form a shape, such as a circle, a polygon, including but not limited to a triangle, quadrilateral, rectangle, pentagon, hexagon, heptagon, octagon, nonagon, decagon, or other shape as appreciated by a person having ordinary skill in the art. As an example, shown in FIGS. 2-5, the interconnected web members 27 form a hexagon shape comprising a first web member 54, a second web member 55, a third web member 56, a fourth web member 57, a fifth web member 58, and a sixth web member 59. The interconnected web members 24 can be positioned and/or formed about substantially all of the body of the mat 10, such as within the mat 10. The interconnected web members 27 may not be positioned within the cantilevered or lips 307, 308 (as shown in FIG. 14) of the mat 10.

In an exemplary aspect, the first web member 54 is coupled to the second web member 55 at a first node 66. The third web member 56 is coupled to the second web member 55 at a second node 67, the fourth web member 57 is connected to the third web member 56 at a third node 68, the fifth web member 58 is coupled to the fourth web member 57 at a fourth node 69, the sixth web member 59 is connected to the fifth web member 58 at a fifth node 70 and the sixth web member 59 is connected to the first web member 54 at a sixth node 71.

In accordance with an exemplary embodiment, the mat 10 includes a plurality of fortifying members 77 that are positioned adjacent to the interconnect web members 27. For example, the fortifying members 77 can be positioned within the voids 62 of the interconnected web members 27, at a side or a wall portion of the interconnected web members 27, at intersections of the interconnected web members 27 and/or a combination of any of these locations. In an embodiment, the fortifying members 77 can be positioned within a substantial portion of the body of the mat 10. The fortifying members 77 may not be positioned within the cantilevered or lips 307, 308 (as shown in FIG. 14) of the mat 10. Any number of the fortifying members 77 can be present within the mat 10 depending on the application. In an embodiment, the mat 10 may comprise at least 1 fortifying member per 5 square inches, or the number of fortifying members may be on the order of 1 every 4 square inches, 1 every 7 square inches, 1 every 10 square inches, 1 every 15 square inches, 1 every 30, or other ratios that should be appreciated by those having ordinary skill in the art.

The fortifying members 77 can be positioned at or along the web members 54-59, at the nodes 66-70, and/or within the voids 62. For example, the fortifying members 77 could be arranged at each of the first node 66, the second node 67, the third node 68, the fourth node 69, the fifth node 70 and the sixth node 71. In an exemplary aspect, a first fortifying member 80 is arranged at the first node 66, a second fortifying member 81 is arranged at the second node 67, a third fortifying member 82 is arranged at the third node 68, a fourth fortifying member 83 is arranged at the fourth node 69, a fifth fortifying member 84 is arranged at the fifth node 70, and a sixth fortifying member 85 is arranged at the sixth node 71. Each of the fortifying members 77 have a thickness and/or diameter that is greater than a thickness and/or diameter at each of the first node 66, the second node 67, the third node 68, the fourth node 69, the fifth node 70 and the sixth node 71.

The fortifying members 77 can extend toward the first side 16 and the second side 18. The fortifying members 77 can extend laterally and perpendicularly with respect to the first side 16 and/or the second side 18. For example, the fortifying members 77 can extend substantially perpendicularly to the length and width of the first portion 12 and/or the second portion 14. The thickness or size of the cross section of the fortifying members 77 may be greater than the thickness or cross-sectional size or area of the interconnected web members 27. A height of the fortifying members 77 may be substantially similar to a height of the interconnected web members 27. The fortifying members 77 can be sized, shaped and configured to provide resilience to crush forces applied to the first side 16 and/or the second side 18 of the mat 10. The fortifying members 77 can be sized, shaped and configured to provide resilient structural support that allow the mat 10 to withstand crush forces applied to the first side 16 and/or the second side 18 of the mat 10 that is greater than the amount of crush force able to be withstood without the fortifying members 77.

Figure 3:
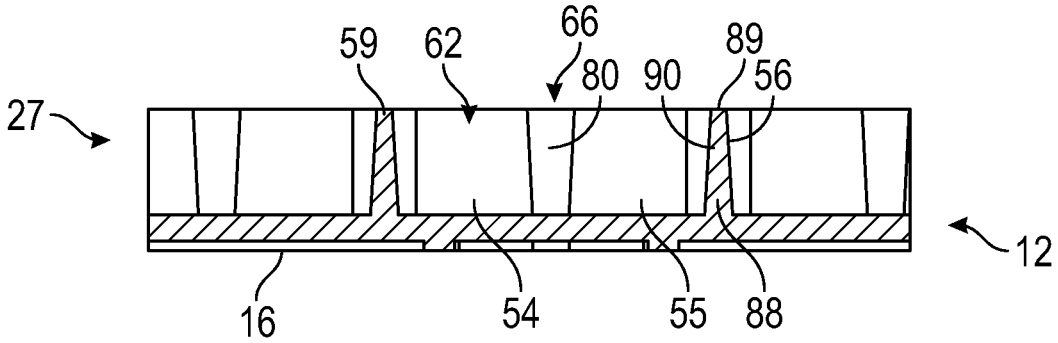
FIG. 3 is a partial side view of the section of the mat illustrated in FIG. 2, in accordance with one or more embodiments of the present disclosure.
Figure 4:
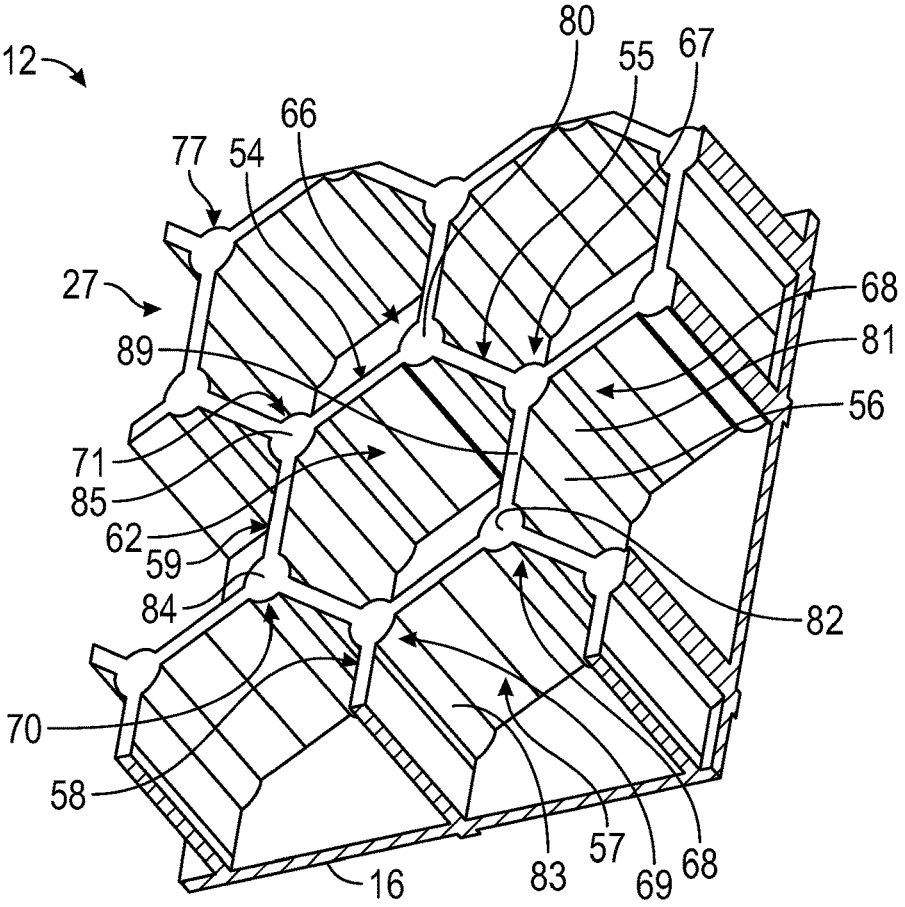
FIG. 4 depicts a partial cross-sectional perspective view of the section of the mat of FIG. 2, in accordance with one or more embodiments of the present disclosure.

In accordance with an exemplary aspect of the present disclosure, tapering the interconnected web members 27 between the first and second mat portions 12 and 14 may ease in manufacturing the mat 10. As an example, as shown in FIG. 3, the third web member 56 includes a first end 88 coupled to the first portion 12, a second end 89, and a tapered intermediate portion 90 that extends between and interconnects the first end 88 and the second end 89. In the embodiment shown, the first end 88 is wider than the second end 89. For example, the It should be understood that each of the plurality of interconnected web members 27 may be tapered in either direction toward the first end 88 or the second end 89.

While the fortifying members 77 are shown as having a generally circular cross-section, it should be understood that other geometries are also contemplated, such as polygons, including but not limited to triangle, quadrilaterals, pentagons, and hexagons. A cross-section of the fortifying members 77 can be hollow or solid. Specifically, the fortifying members 77 can be solid or hollow from the base to the end of the fortifying members 77. In a hollow embodiment, the fortifying members 77 may have a wall defining an exterior and an interior void of material. In an embodiment where the fortifying members 77 are solid, material may substantially fill an interior of the fortifying members 77.

In accordance with an exemplary aspect of the present disclosure, the fortifying members 77 may be tapered. For example, the fortifying members 77 can have a first end (not separately labeled) and a second end (also not separately labeled) opposite to the first end. The height of the fortifying members 77 may be defined between the first end and the second end. The first end may be joined to first side 16 and/or the second side 18. The fortifying members 77 can have a first dimension at the first end and a second dimension at the second end that is different from the first dimension, such as greater or less than the first dimension. The tapering of the interconnected web members 27 and/or the fortifying members 77 may allow the first portion 12 and/or the second portion 14 of the mat 10 to be releasable from a mold or other structure. Further, tapering the plurality of interconnected web members 27 and/or the fortifying members 77 may contribute to lowering an overall weight of the mat 10 while maintaining structural stability. Thus, the mat 10, in accordance with the exemplary embodiments of the present disclosure, is easily manufacturable and lightweight yet maintains the ability to support loads associated with various industrial ground cover applications. It should be understood that while shown and described as including tapering portions, the interconnected web members 27 and the fortifying members 77 may be formed to have a substantially constant cross-section as discussed in connection with embodiments of the present disclosure.

Figure 5:
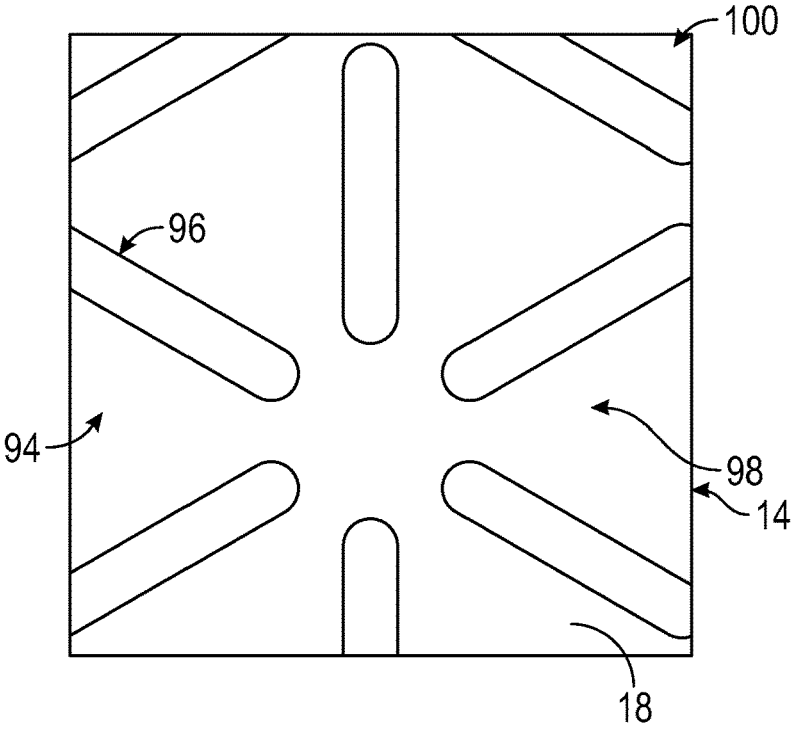
FIG. 5 depicts a plan view of a surface of the mat of FIG. 1, in accordance with one or more embodiments of the present disclosure.

Referring to FIG. 5, an exterior or outer surface (not separately labeled) of the second side 18 of second portion 14 is shown. The outer surface of the second side 18 includes treads 94. The treads 94 may comprise raised tread elements 96 that may provide traction, grip or otherwise a textured surface. The outer surface of the second side 18 can include areas of flat or non-raised portions 98. The tread elements 96 may form a shape or pattern, such as, a cross shape, an asterisk shape, crisscross, herring bone, or other pattern or shape. Each of the raised tread elements 96 may be spaced from one another as shown in FIG. 5 or, in an alternative arrangement (not shown) two or more of the raised elements 96 may be connected.

In an embodiment of the present disclosure, the treads 94 are formed from any number of the raised tread elements 96. The treads 94 may be positioned along substantially all of the first surface portion 20. Some of the raised tread elements 96 may extend at an angle relative to the first and second edges 20 and 22 while others of the raised tread elements 96 may extend substantially parallel to the first edge 20.

Figure 6:
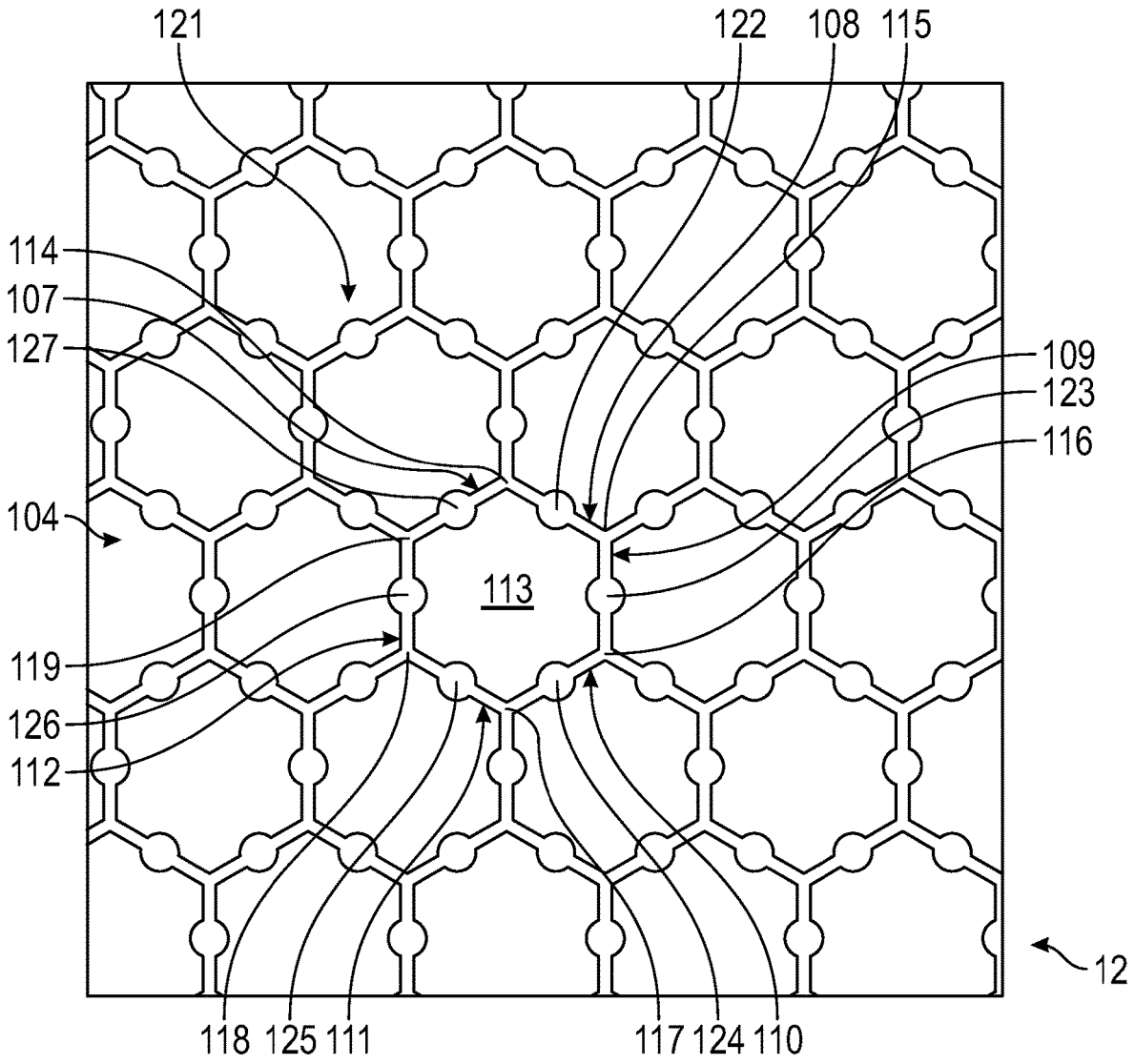
FIG. 6 depicts a partial plan view of the section of a mat, in accordance with one or more embodiments of the present disclosure.

Reference will now follow to FIG. 6 in describing the interconnected web members 104 positioned in the mat 10 in accordance with another aspect of the present disclosure. The interconnected web members 104 can be wall-like structures that are positioned between the first portion 12 and the second portion 14. The interconnected web member 104 can have portions or sections joined, integrally formed or otherwise attached in a shape to provide structural support for the mat 10. The interconnected web members 104 can define or form a shape, such as a circle, a polygon, including but not limited to a triangle, quadrilateral, rectangle, pentagon, hexagon, heptagon, octagon, nonagon, decagon, or other shape as appreciated by a person having ordinary skill in the art. As an example, shown in FIG. 6, the interconnected web members 104 form a hexagon shape comprising a first web member 107, a second web member 108, a third web member 109, a fourth web member 110, a fifth web member 111, and a sixth web member 112 that are joined. The interconnected web members 104 can be attached or integrally joined to one another and the first portion 12 and/or the first side 16 of the mat 10. The interconnected web members 27 can then form the voids 113.

In an exemplary aspect of the present disclosure, the first web member 107 is coupled to the second web member 108 at a first node 114. The third web member 109 is coupled to the second web member 108 at a second node 115, the fourth web member 110 is connected to the third web member 109 at a third node 116, the fifth web member 111 is coupled to the fourth web member 110 at a fourth node 117, the sixth web member 112 is connected to the fifth web member 111 at a fifth node 118. The sixth web member 112 is also is connected to the first web member 54 at a sixth node 119.

In accordance with an exemplary embodiment of the present disclosure, a plurality of fortifying members 121 are positioned within the interconnect web members 104. The fortifying members 121 extend from, are integrally formed with or are otherwise connected to the first portion 12 and can extend toward the first side 16 and the second side 18.

The fortifying members 121 can extend laterally and perpendicularly with respect to the first side 16 and/or the second side 18. For example, the fortifying members 121 can extend substantially perpendicularly from first side 16 and/or the second side 18. The thickness of the fortifying members 121 may be greater than the thickness of the interconnected web members 104. A height of the fortifying members 121 may be substantially similar to a height of the interconnected web members 104. The fortifying members 121 can be sized, shaped and configured to provide resilient structural support that allow the mat 10 to withstand crush forces applied to the first side 16 and/or the second side 18 of the mat 10. While the fortifying members 121 are shown as having a generally circular cross-section, it should be understood that other geometries are also contemplated, such as polygons, including but not limited to triangle, quadrilaterals, pentagons, and hexagons. In accordance with an exemplary aspect of the present disclosure, the plurality of fortifying members 121 may have a base (not separately labeled) and an end (also not separately labeled. The base may be joined to first side 16. The base may include a first dimension and the end may include a second dimension that is distinct from the first dimension. The first dimension may be greater than the second dimension. A cross-section of the fortifying members 121 can be hollow or solid. In an embodiment where the fortifying members 121 are solid, material may substantially fill an interior of the fortifying members 121. In a hollow embodiment, the fortifying members 121 may have a wall defining an exterior and an interior void of material. The fortifying members 121 can be positioned at or along the plurality of interconnected web member 104 at the nodes 114-119, and/or within the voids 113. The fortifying members 121 extend substantially perpendicularly from the first side 16.

In an exemplary aspect of the present disclosure, a first fortifying member 122 is attached to and/or integrally formed with the second web member 108 between the first node 114 and the second node 115, a second fortifying member 123 is attached to and/or integrally formed with the third web member 109 between the second node 115 and the third node 116, a third fortifying member 127 is attached to and/or integrally formed with the fourth web member 110 between the third node 116 and the fourth node 117, a fourth fortifying member 125 is attached to and/or integrally formed with the fifth web member 111 between the fourth node 117 and the fifth node 118, a fifth fortifying member 126 is attached to and/or integrally formed with the sixth web member 112 between the fifth node 118 and the sixth node 119, and a sixth fortifying member 127 is attached to and/or integrally formed with the first web member 107 between the sixth node 119 and the first node 114.

Figure 7:
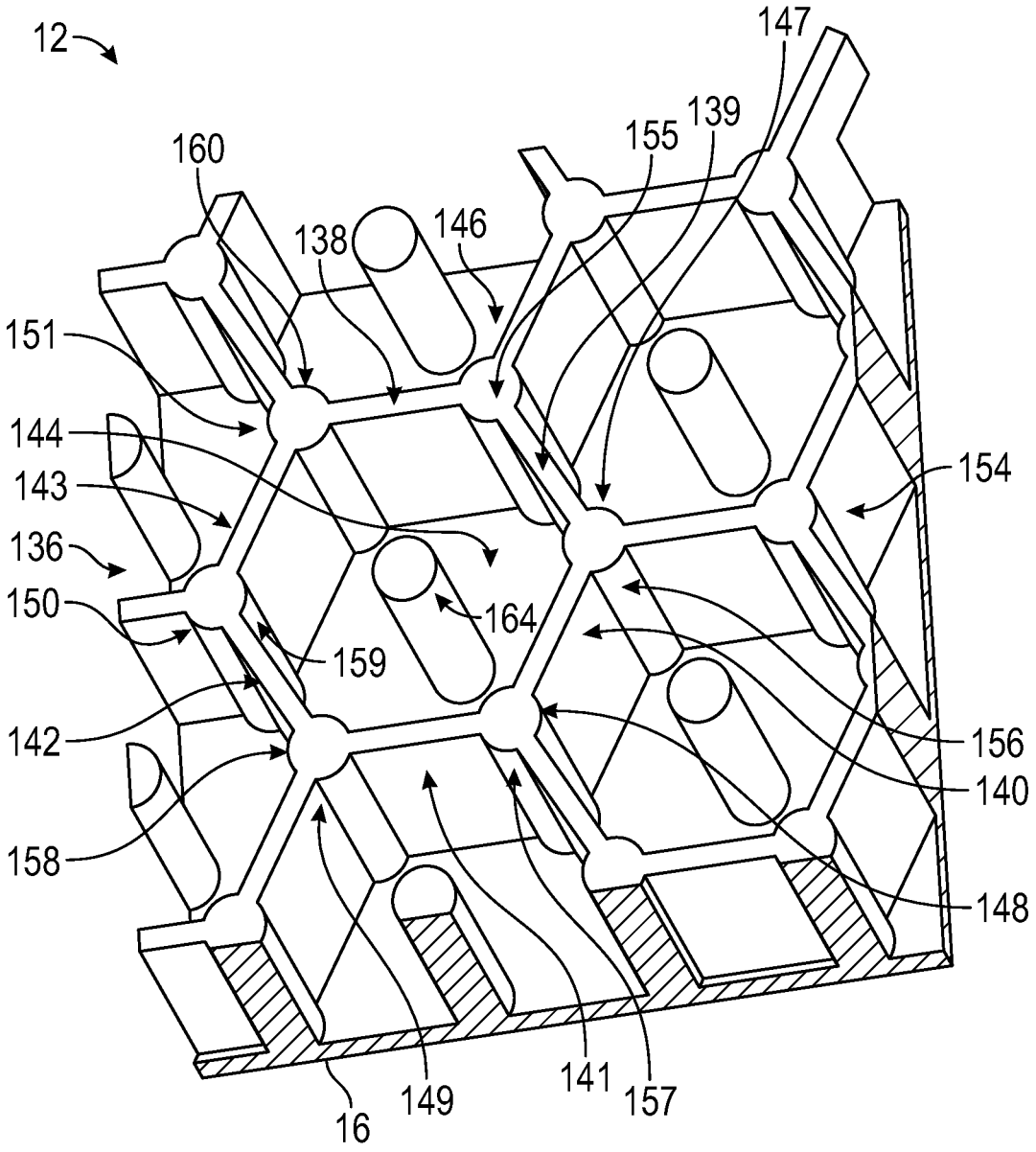
FIG. 7 depicts a partial perspective view of the section of a mat, in accordance with one or more embodiments of the present disclosure.

Reference will now follow to FIG. 7 in describing a plurality of interconnected web members 136 in accordance with another aspect of an exemplary embodiment of the present disclosure. The interconnected web member 136 can have portions or sections joined, integrally formed or otherwise attached in a shape to provide structural support for the mat 10. The interconnected web members 136 can define or form a shape, such as a circle, a polygon, including but not limited to a triangle, quadrilateral, rectangle, pentagon, hexagon, heptagon, octagon, nonagon, decagon, or other shape as appreciated by a person having ordinary skill in the art. As an example, shown in FIG. 7, the interconnected web members 136 form a hexagon shape comprising a first web member 138, a second web member 139, a third web member 140, a fourth web member 141, a fifth web member 142, and a sixth web member 143 that are joined. The interconnected web members 136 can be attached or integrally joined to one another and the first portion 12 and/or the first side 16 of the mat 10. The interconnected web members 27 can then form the voids 144.

In an exemplary aspect, the first web member 138 is coupled to the second web member 139 at a first node 146. The third web member 140 is coupled to the second web member 139 at a second node 147, the fourth web member 141 is connected to the third web member 140 at a third node 148, the fifth web member 142 is coupled to the fourth web member 141 at a fourth node 149, and the sixth web member 143 is connected to the fifth web member 142 at a fifth node 150. The sixth web member 143 is also is connected to the first web member 138 at a sixth node 151.

In accordance with an exemplary embodiment of the present disclosure, a plurality of fortifying members 154 define an area of increased size at select locations throughout the plurality of interconnected web members 136 and extend substantially perpendicularly from first side 16. The plurality of fortifying members 154 extend from and is integrally formed with or are otherwise connected to the first portion 12 and can extend toward the second side 18. The fortifying members 154 can extend laterally and perpendicularly with respect to the first side 16 and/or the second side 18. For example, the fortifying members 154 can extend substantially perpendicularly from first side 16 and/or the second side 18. The thickness of the fortifying members 154 may be greater than the thickness of the interconnected web members 136. A height of the fortifying members 154 may be substantially similar to a height of the interconnected web members 136. The fortifying members 154 can be sized, shaped and configured to provide resilient structural support that allow the mat 10 to withstand crush forces applied to the first side 16 and/or the second side 18 of the mat 10.

While the fortifying members 154 are shown as having a generally circular cross-section, it should be understood that other geometries are also contemplated, such as polygons, including but not limited to triangle, quadrilaterals, pentagons, a hexagons. In accordance with an exemplary aspect of the present disclosure, the plurality of fortifying members 154 may have a base (not separately labeled) and an end (also not separately labeled. The base may be joined to first side 16. The base may include a first dimension and the end may include a second dimension that is distinct from the first dimension. The first dimension may be greater than the second dimension. A cross-section of the fortifying members 154 can be hollow or solid. In an embodiment where the fortifying members 154 are solid, material may substantially fill an interior of the fortifying members 154. In a hollow embodiment, the fortifying members 154 may have a wall defining an exterior and an interior void of material. The fortifying members 154 can be positioned at or along the plurality of interconnected web members 136 at the nodes 146-450, and/or within the voids 144. For example, the fortifying members 154 extend substantially perpendicularly from the first side 16.

In an exemplary aspect, a first fortifying member 155 is attached to and/or integrally formed with the first node 146, a second fortifying member 156 is attached to and/or integrally formed with the second node 147, a third fortifying member 157 is attached to and/or integrally formed with the third node 148, a fourth fortifying member 158 is attached to and/or integrally formed with the fourth node 149, a fifth fortifying member 159 is attached to and/or integrally formed with the fifth node 150, and a sixth fortifying member 160 is attached to and/or integrally formed with the sixth node 151. In an exemplary aspect, a seventh fortifying member 164 is arranged within void 144. That is, seventh fortifying member 164 projects substantially perpendicularly outwardly of first side 16 within void 144 to provide additional structural support for plurality of web members 136.

Figure 8:
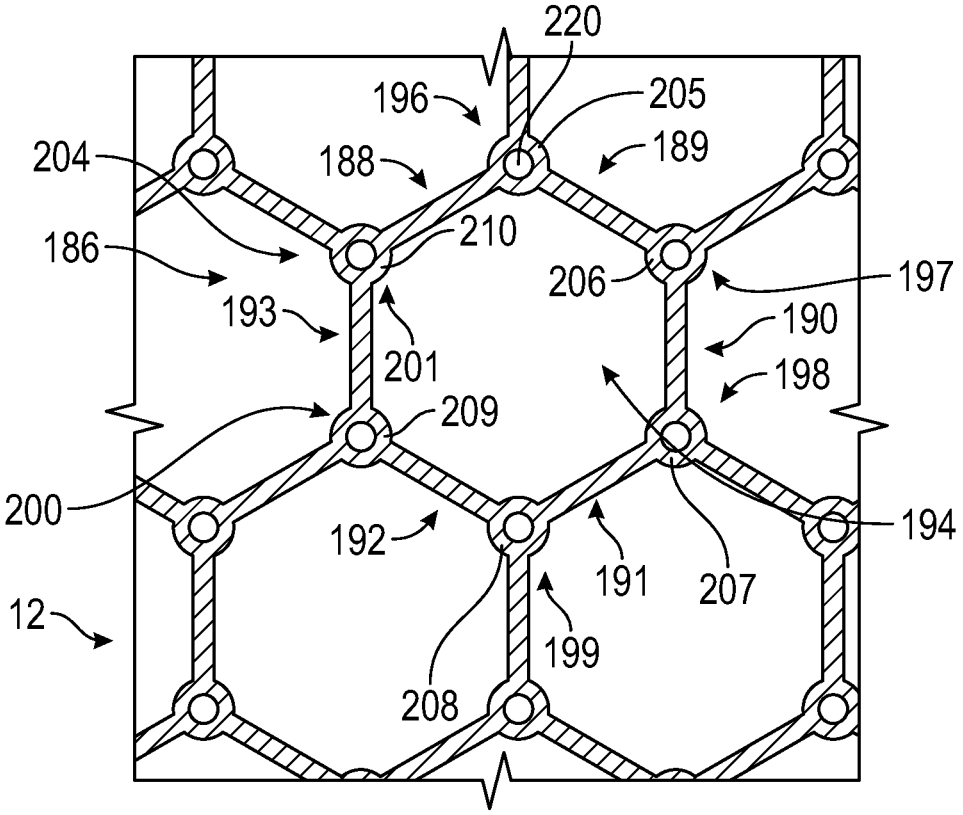
FIG. 8 depicts a partial plan view of the section of the mat illustrated in FIG. 1, in accordance with one or more embodiments of the present disclosure.

Reference will now follow to FIG. 8, in describing a plurality of interconnected web members 186 in accordance with another aspect of an exemplary embodiment of the present disclosure. The interconnected web member 186 can have portions or sections joined, integrally formed or otherwise attached in a shape to provide structural support for the mat 10. The interconnected web members 186 can define or form a shape, such as a circle, a polygon, including but not limited to a triangle, quadrilateral, rectangle, pentagon, hexagon, heptagon, octagon, nonagon, decagon, or other shape as appreciated by a person having ordinary skill in the art.

As an example, shown in FIG. 8, the interconnected web members 186 form a hexagon shape comprising a first web member 188, a second web member 189, a third web member 190, a fourth web member 191, a fifth web member 192, and a sixth web member 193 that are joined. The interconnected web members 186 can be attached or integrally joined to one another and the first portion 12 and/or the first side 16 of the mat 10. The interconnected web members 27 can then form voids 194.

In an exemplary aspect, the first web member 188 is coupled to the second web member 189 at a first node 196. The third web member 190 is connected to the second web member 189 at a second node 197, the fourth web member 191 is connected to the third web member 190 at a third node 198, the fifth web member 192 is coupled to the fourth web member 191 at a fourth node 199, and the sixth web member 193 is connected to the fifth web member 192 at a fifth node 200. The sixth web member 193 is also is connected to the first web member 188 at a sixth node 201.

In accordance with an exemplary embodiment, the first portion 12 includes a plurality of hollow fortifying members 204 that define an area of increased size at select locations throughout the plurality of interconnected web members 186 and extend substantially perpendicularly from the first side 16. While shown as having a generally circular cross-section, it should be understood that other geometries are contemplated.

The plurality of hollow fortifying members 204 extend from, are integrally formed with or are otherwise connected to the first portion 12 and can extend toward the the second side 18. The hollow members 204 can extend laterally and perpendicularly with respect to the first side 16 and/or the second side 18. For example, the hollow fortifying members 204 can extend substantially perpendicularly from first side 16 and/or the second side 18. The thickness of the hollow fortifying members 204 may be greater than the thickness of the interconnected web members 186. A height of the hollow fortifying members 204 may be substantially similar to a height of the interconnected web members 186. The hollow fortifying members 204 can be sized, shaped and configured to provide resilient structural support that allow the mat 10 to withstand crush forces applied to the first side 16 and/or the second side 18 of the mat 10.

While the fortifying members 204 are shown as having a generally circular cross-section, it should be understood that other geometries are also contemplated, such as polygons, including but not limited to triangle, quadrilaterals, pentagons, and hexagons. In accordance with an exemplary aspect of the present disclosure, the plurality of fortifying members 204 may have a base (not separately labeled) and an end (also not separately labeled. The base may be joined to first portion 12. The base may include a first dimension and the end may include a second dimension that is distinct from the first dimension. The first dimension may be greater than the second dimension. The hollow fortifying members 204 have an outer wall 212 (FIG. 9) defining an exterior and an inner wall 214 that defines an interior void of material. The hollow fortifying members 204 can be positioned at or along the plurality of interconnected web member 186 at the nodes 196-201, and/or within the voids 194. For example, the hollow fortifying members 204 extend substantially perpendicularly from the first side 16.

In an exemplary aspect, a first fortifying member 205 is attached to and/or integrally formed with the first node 196, a second fortifying member 206 is attached to and/or integrally formed with the second node 197, a third fortifying member 207 is attached to and/or integrally formed with the third node 198, a fourth fortifying member 208 is attached to and/or integrally formed with the fourth node 199, a fifth fortifying member 209 is attached to and/or integrally formed with the fifth node 200, and a sixth fortifying member 210 is attached to and/or integrally formed with the sixth node 201.

Figure 9:
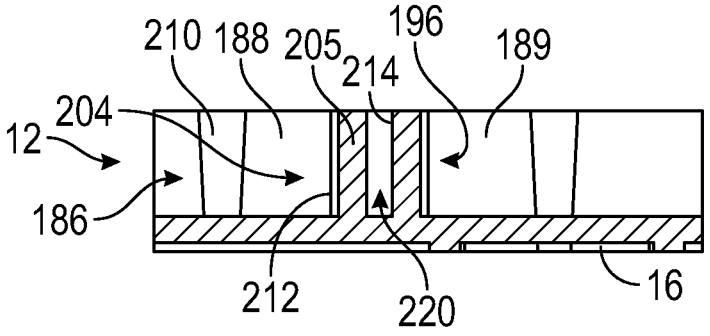
FIG. 9 is a partial side view of the section of the mat illustrated in FIG. 8, in accordance with one or more embodiments of the present disclosure.

In accordance with an exemplary aspect, each of the fortifying members 204 include a hollow cross-section defining a central opening 220 shown in FIG. 9. In further accordance with an exemplary embodiment of the present disclosure, despite the removal of material to form the central opening 220, each of the plurality of hollow fortifying member 204 maintains a volume that is substantially similar to the other fortifying members disclosed herein. The hollow cross-section also promotes enhanced bending performance over solid fortifying members without sacrificing load carrying capacity.

Figure 10:
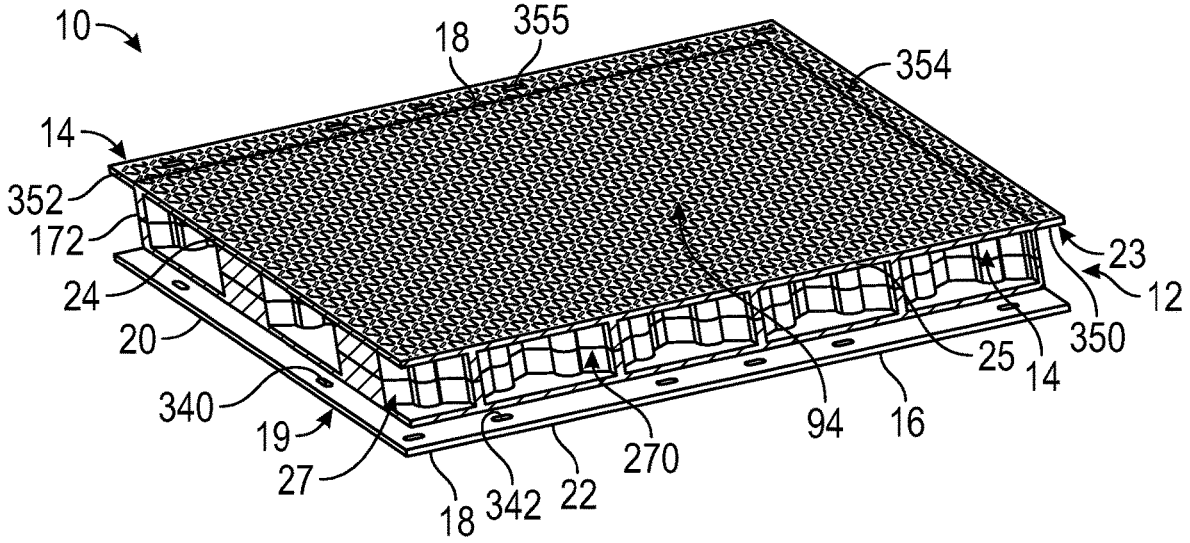
FIG. 10 depicts a partially cut-away perspective view of a mat, in accordance with one or more embodiments of the present disclosure.

In accordance with one arrangement, the interconnected web members 27 can be geometrically aligned with and coupled to the second plurality of interconnected web members 270 as shown in FIG. 10, In this manner, the plurality of interconnected web members 27 and the plurality of interconnected web members 270 extend substantially continuously vertically between the first side 16 of the first portion 12 and the second side 18 of the second portion 14 thereby rigidly coupling the first portion 12 and the second portion 14.

Figure 11:
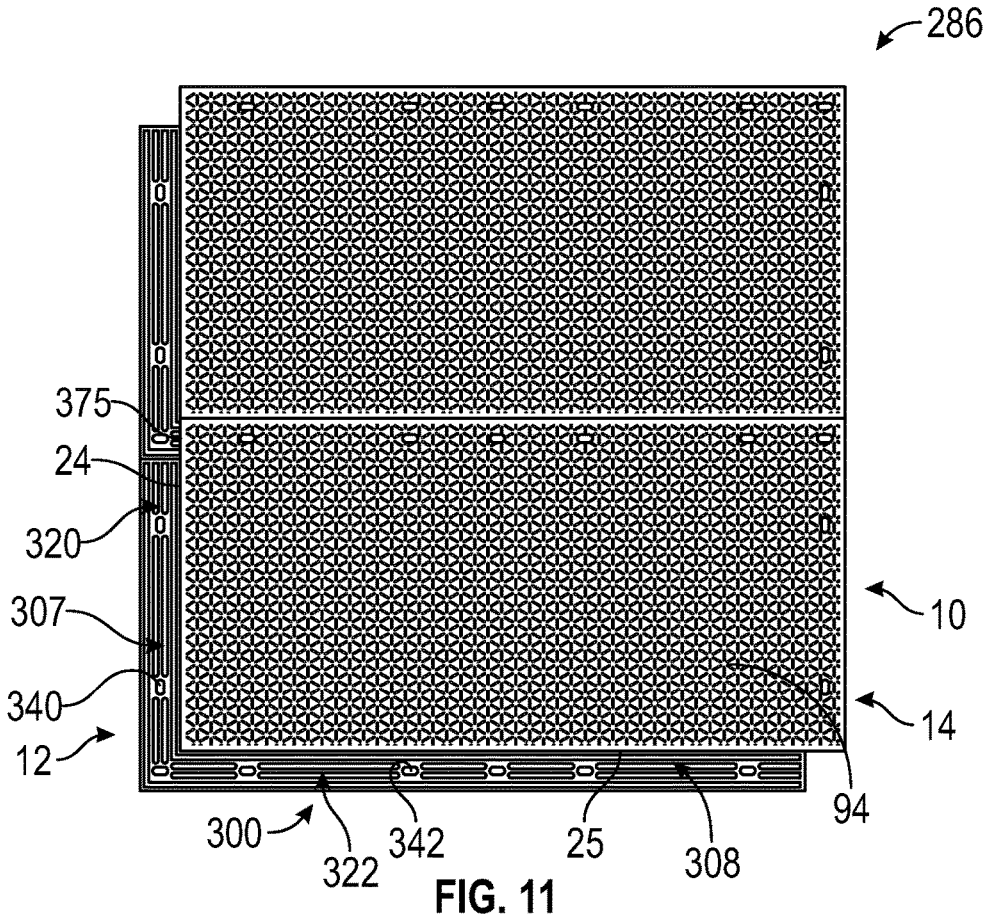
FIG. 11 depicts a plan view of a mat, in accordance with a one or more embodiments of the present disclosure.

The mat 10 may be connected to another mat 282 as shown in FIG. 11 to form a modular mat system as will be discussed herein. In an exemplary embodiment of the disclosure as shown in FIG. 1, the first portion 12 of the mat 10 includes a first lip 307 and an adjacent second lip 308. The first lip 307 and the second lip 308 can be arranged substantially perpendicularly relative to one another. The first lip 307 and the second lip 308 can include pin openings 340 and 342 respectively that may accommodate fasteners for securing the mat 10 to another mat, such as the mat 282. Each lip 307 and 308 can have a thickness that is less than a thickness of the body of the mat 10. For example, the thickness of the lips 307, 308 may be approximately half of the thickness of the mat 10 such that the lip 307, 308 of the mat 10 can be positioned on the lip 307, 308 of the mat 282 to form a surface having uniform thickness across the mats 10, 282. The mats 10, 282 can then be secured with pins or other fasteners at the pin openings 340, 342.

Figure 12:
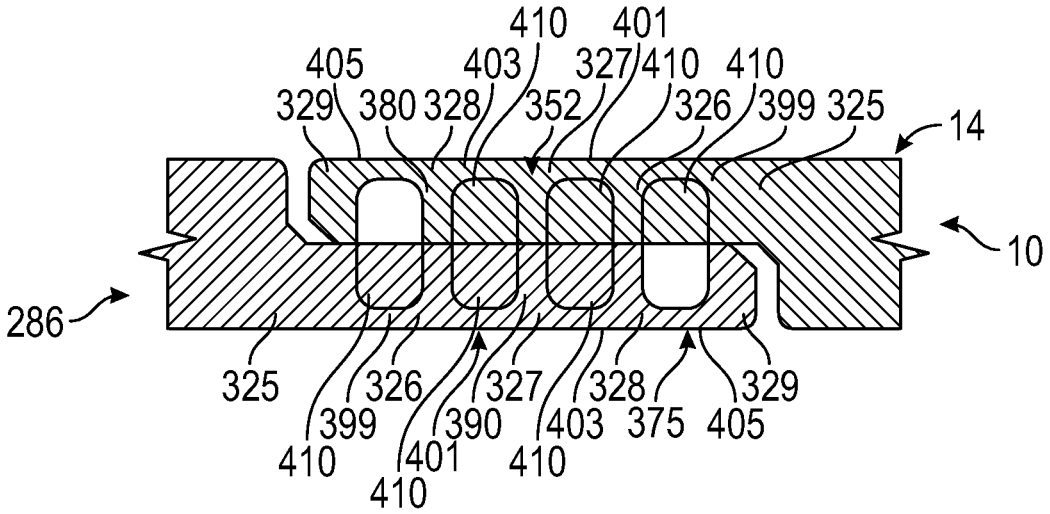
FIG. 12 depicts a cross-sectional side view of a section of a mat, in accordance with one or more embodiments of the present disclosure.

The first lip 307 includes ribs 320 and the second lip 308 includes ribs 322. The ribs 320 in the first lip 307 extend along a width of the mat 10, and the ribs 322 in the second lip 308 extend along a length of the mat 10. Referring to FIG. 1, the ribs 320 can include a first rib 325, a second rib 326, a third rib 327, a fourth rib 328 a fifth rib 329 and a sixth rib 330 (FIGS. 12, 15A). Between each of the ribs 320 can include channel portions, such as first channel 399, second channel 401, third channel 403 and fourth channel 405. The ribs 325-329 can extend along the first lip 307 substantially parallel to the first edge 20. The ribs 322 can include a first rib member 330, a second rib member 331, a third rib member 332, a fourth rib member 333, a fifth rib member 334, and a sixth rib member (not separately labeled). The rib members 330-334 can extend along the second lip 308 substantially parallel to the second edge 22. The channels 399,401,403,405 can be joined with the ribs 320, 325 to form an undulating shape with gaps or voids 412 (see FIG. 16) above each of the channels 399,401,403,405. The first lip 307 and the second lip 308 can be comprised of any number of the channels 399,401,403,405 and the ribs 320, 322 in successive order to form this undulating shape of peaks and valleys.

Figure 16:
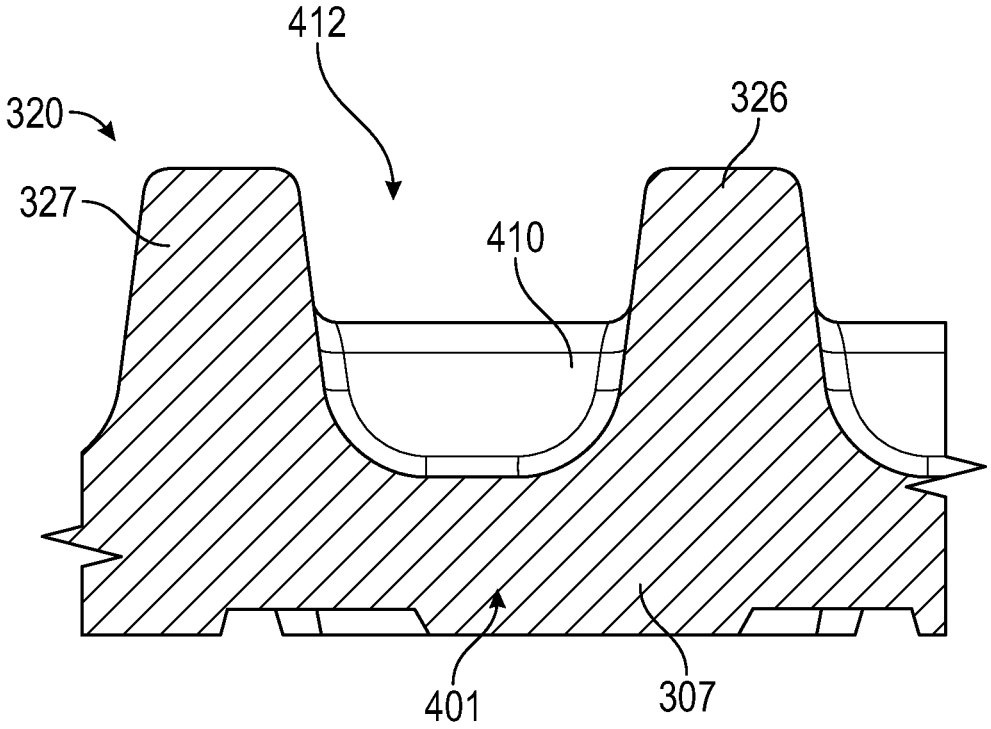
FIG. 16 depicts a side view of the lip stiffener of FIG. 15A, in accordance with one or more embodiments of the present disclosure.

The length of each of the channels 399,401,403,405 can be greater than a length of each of the ribs 320, 325. The channels 399,401,403,405 can have a thickness (or height) less than a thickness (or height) of the ribs 320, 325, as shown in FIG. 16. Each of the ribs 320, 325 can have a thickness. In an embodiment of the disclosure, the first rib 325 can have a first thickness, the second rib 326 can have a second thickness, the third rib 327 can have a third thickness, the fourth rib 328 can have a fourth thickness, the fifth rib 329 may have a fifth thickness, and the sixth rib 330 may have a sixth thickness. The first, second, third, fourth and fifth thicknesses may be substantially similar or even equal. In another embodiment, the thicknesses of each of the ribs 320, 325 can be greatest adjacent the body of the mat 10, 286 and least farthest from the mat 10, 286. For example, the first thickness can be greater than the second thickness; the third thickness can be less than the second thickness; the fourth thickness can be less than the third thickness; the fifth thickness less than the fourth thickness; and the sixth thickness less than the fifth thickness. Each of the ribs 320, 325 may be tapered and decrease in size from the first side 16 to the second side 18, or otherwise from the base of each of the ribs 320, 325 to an end outward of the base of each of the ribs 320, 325.

The voids 412, as best shown in FIG. 16 can be formed above each of the channels 399,401,403,405 to reduce weight of the mat 10, 286 and can provide flexibility to the lips 307, 308. For example, the ribs 320, 322 may permit a greater flexibility of the lip by permitting the ribs 320, 322 to bend or flex toward or away from one another without cracking or breaking the lips 307, 308.

The second portion 14 includes a first lip portion 350 and a second lip portion 352. each having corresponding pin openings 354 and 355. When first portion 12 is joined to second portion 14, the first lip 307 of the mat 10 projects outwardly of the first edge portion 20 of the second portion 14 and the second lip 308 of the first portion 12 projects outwardly of the second edge portion 25 of the second portion 14. Similarly, the first lip portion 350 of the second portion 14 projects outwardly of the third edge of the first portion 12 and the second lip portion 352 of the second portion 14 projects outwardly of the fourth edge of the first portion 12. With this arrangement, second lip portion 352 may be joined to a lip 375 (FIG. 12) of the another mat 282 (FIG. 11).

The second lip portion 352 and the lip 375 include ribs, such as indicated at 380 and 390 in FIG. 12 that align with one another to provide structural rigidity and support while, at the same time, reducing an overall weight of the mat 10. Fasteners (not shown) may passed through pin openings 355 and pin openings (not shown) in the another mat 286 to form a mechanical connection. Additional mat components may then be added to form a ground cover having a selected shape.

Figure 13:
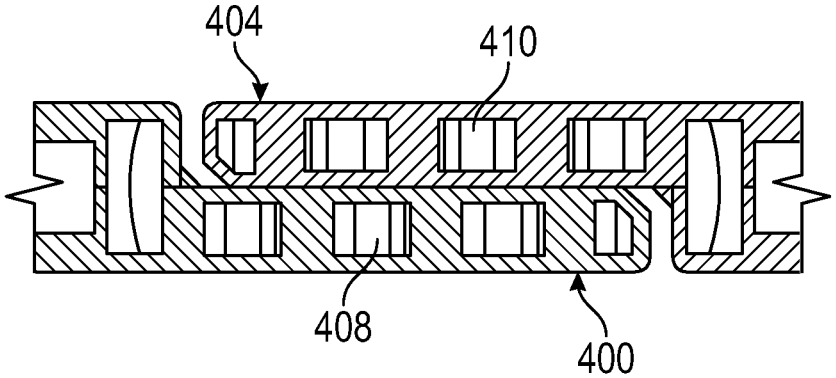
FIG. 13 depicts a cross-sectional side view of a section of a mat, in accordance with one or more embodiments of the present disclosure.

Referring to FIG. 13, a first lip 400 is shown being connected to a second lip portion 404 in accordance with another aspect of the present disclosure. In lieu of ribs, the first lip 400 may include a first series of voids 408 and the second lip portion 404 may include a second series of voids 412 that are fully encapsulated within the corresponding ones of the first lip 400 and the second lip portion 404. The number, length, geometry, and arrangement of voids 408 and 412 may vary. The inclusion of voids 408 and the voids 412 provides a desired weight reduction and flexibility in corresponding ones of the first lip 400 and the second lip portion 404 without sacrificing structural integrity and load bearing capacity.

With reference to FIGS. 12 and 14, in describing lip stiffeners 410 arranged along the first lip 307 with an understanding that second lip 308 may include similar lip stiffeners 410. The lip stiffeners 410 may extend along the voids 412. For example, as best shown in FIG. 16, the lip stiffener 410 can comprise material extending between the ribs 320, 322. FIG. 16 illustrates the lip stiffener 410 extending between the second rib 326 and the third rib 327. The lip stiffeners 410 can comprise material filling a portion or substantially all of the voids 412 of the channels 399, 401,403,405. The lip stiffeners 410 can be integrally formed with the ribs 320, 322 or separately formed. The material of the lip stiffeners 410 can be the same as that of the ribs 320, 322 or may have a different density, such as a lower or higher density depending on the need for flexibility, crush strength of other properties. The lip stiffeners 410 can be molded onto each of the first lip 307 and the second lip 308 and extend perpendicularly relative to the ribs 320, 322. The lip stiffeners 410 may also be molded into, as a separated component, each of the first lip 307 and the second lip 308. The lip stiffeners 410 may be formed from the same material as the mat 10 or may be formed from a different material having a different stiffness. The lip stiffeners 410 may extend from first rib 325 to sixth rib 330 and/or extend from first rib 325 and terminate at the opening 340 or at another one of the ribs 320, 322 as discussed herein. For example, as shown in FIG. 12, the lip stiffener 410 extends from the body of the mat 10, 286 outward to the lips 307, 308 and terminates prior to the fifth rib 329. The lip stiffener 410 can extend along any number of the ribs 320, 322. The lip stiffener 410 extending from the body of the mat 10, 286 into the void formed between the first rib 325 and the second rib 326 can minimize and/or restrict breaking, cracking or other damage to the mat 10, 286 at the area of the first rib 325 near the location the lips 320, 322 meet the body of the mat 10, 286, It is at this location that the lips 320, 322 may be most susceptible to breaking or cracking, and, therefore, the lip stiffener 410 provides an advantage to distribute and otherwise spread the force of any load on the lips 320, 322 across the surface of the lips 320, 322. To this end, the stiffeners 412 provide additional mechanical support and increase an overall flexibility for the first lip 307 and the second lip 308 to accommodate vehicle loading impact loading and the like. It should be understood that the first lip portion 350 and the second lip portion 352 also include lip stiffeners (not shown).

In an embodiment of the present disclosure illustrated in FIG. 15A, the plurality of lip stiffeners 410 is depicted as a transverse rib that extends from, for example, the first rib 325 to the sixth rib 330 at first edge 20. The lip stiffener 410 can have a uniform width, and a uniform height. For example, the lip stiffener 410 may include a width of about 1-inch (2.54-cm) and a height of about 0.75-inch (1.9-cm) as shown in FIG. 16. FIG. 15B depicts the lip stiffeners 410 as a transverse rib 430 that extends across the ribs 320 from the first rib 325 to the third rib 327 thereby terminating short of the first edge 20.

FIG. 15C depicts the lip stiffener 410 as a transverse rib 434 that extends across the ribs 320 from the first rib 325 to the fifth rib 329 thereby terminating short of the first edge 20. The transverse rib 434 includes a first end 436 positioned at the first rib 325 and a second, terminal end 438 positioned at the fifth rib 329. The first end 436 includes a first width and the second, terminal end 438 includes a second width that is less than the first width. FIG. 15D depicts the lip stiffeners 410 as a first transverse rib 440 and a second transverse rib 442 each of which extend between the first rib 325 and the fifth rib 329. The first transverse rib 440 may be spaced from the second transvers rib 442 a distance of about 2-inches (5.08-cm). FIG. 15E depicts the lip stiffeners 410 as a transverse rib 450 that extends between the first rib 325 and the fourth rib 328.

It should be understood from the above that the lip stiffeners 410 may extend entirely across each lip 320, 322 and/or may extend partially across each lip 320, 322. Also, the number of lip stiffeners 410 may vary, the lip stiffeners may be arranged in groups that are spaced close together and/or may be evenly distributed along one or more of the lips. Lip stiffeners may originate at outer lip 420 and terminate short of, for example, the first side 16. Also, the height and width of the lip stiffeners may vary.

For example, in an embodiment, the mat 10 formed in accordance with exemplary embodiments may be about 22% lighter than comparable mats currently available without sacrificing support and flexibility characteristics. That is, the mat constructed in accordance with an exemplary embodiments of the present disclosure may sustain loads similar to existing mats with only a marginal increase in surface displacement. That is, the design, size and shape of the interconnected web members along with a selected distribution of fortifying members leads to a lighter weight mat that provides desired load supporting characteristics.

Preferred embodiments of the present disclosure thus offer advantages over the prior art and are well adapted to carry out one or more of the objects of this disclosure. However, the present disclosure does not require each of the components and acts described above and is in no way limited to the above-described embodiments or methods of operation. Any one or more of the above components, features and processes may be employed in any suitable configuration without inclusion of other such components, features and processes. Moreover, the present disclosure includes additional features, capabilities, functions, methods, uses and applications that have not been specifically addressed herein but are, or will become, apparent from the description herein, the appended drawings and/or claims.

While exemplary embodiments have been shown and described, many variations, modifications and/or changes of the system, apparatus and methods of the present disclosure, such as in the components, details of construction and operation, arrangement of parts and/or methods of use, are possible, contemplated by the patent applicant(s) hereof, within the scope of any appended claims, and may be made and used by one of ordinary skill in the art without departing from the spirit, teachings and scope of this disclosure and any appended claims. Thus, all matter herein set forth or shown in the accompanying drawings should be interpreted as illustrative, and the scope of the disclosure and any appended claims should not be limited to the embodiments described and shown herein.

What is claimed is:

1. A mat comprising:

a first side and a second side opposite the first side, the mat having a body with a thickness defined between the first side and the second side, a width defined between a first edge and a second edge, the second edge opposite the first edge, wherein a thickness direction is defined in a direction from the first side to the second side;

and a lip extending from the body of the mat, wherein the first side, the second side, and the lip are integrally formed to define an integrally formed mat, the lip comprising:

a first rib having a first rib thickness in the thickness direction, and a first channel portion integrally formed with the first rib and having a first channel thickness in the thickness direction, wherein the first rib thickness is greater than the first channel thickness, a second rib having a second rib thickness in the thickness direction that is greater than the first channel thickness such that a void is positioned between the first rib and the second rib with the first channel positioned between the first rib and the second rib, and a lip stiffener extending between the first rib and the second rib and filling at least a portion of the void between the first rib and the second rib.

2. The mat of claim 1 further comprising:

a plurality of fortifying members positioned between the first side and the second side and extending within the body in the thickness direction, the plurality of fortifying members integrally formed with at least one of the first side or the second side.

3. The mat of claim 1, wherein at least a portion of the plurality of fortifying members includes a substantially circular cross-section.

4. The mat of claim 1, wherein at least some of the plurality of fortifying members are arranged in a polygonal-shape, the mat further comprising:

a plurality of interconnected web members extending between the fortifying members arranged in the polygonal-shape and defining a polygonal-shaped void therebetween.

5. The mat of claim 1, wherein at least one fortifying member comprises a central opening and defines a hollow fortifying member.

6. The mat of claim 1, wherein at least one fortifying member comprises a taper in the thickness direction.

7. The mat of claim 1, further comprising:

a plurality of interconnected web members extending within the body, a first interconnected web member joined to a second interconnected web member at a first node, and a third interconnected web member joined to the second interconnected web member at a second node, wherein a first fortifying member of the plurality of fortifying members is positioned at the first node and a second fortifying member of the plurality of fortifying members is positioned at the second node.

8. The mat of claim 7, wherein the first fortifying member and the second fortifying member are enlarged with respect to the first, second and third interconnected web members.

9. The mat of claim 7, wherein the plurality of interconnected web members are joined to form a void, wherein at least one of the plurality of fortifying members is positioned within the void.

10. The mat of claim 7, wherein a portion of the plurality of interconnected web members are integrally formed with a first portion of the mat and another portion of the plurality of interconnected web members are integrally formed with a second portion of the mat, and further wherein the first portion and the second portion of the mat are joined to define the thickness of the mat.

11. The mat of claim 1, further comprising:

a third rib of the lip having a third rib thickness, wherein the first rib is closest to the body of the mat, the third rib is farthest from the body of the mat, and the second rib is positioned between the first rib and third rib; and a second channel formed between the second rib and the third rib, the second channel having a second channel thickness, wherein the second channel thickness is less than the second rib thickness and the third rib thickness such that a void is formed between the second channel, the second rib and the third rib.

12. The mat of claim 11 wherein the lip stiffener extends across the second channel.

13. The mat of claim 11 wherein the first rib, the second rib, the third rib, and the voids between the ribs form an exterior surface with an undulating shape.

14. A mat comprising:

a body having a width defined between a first edge and a second edge and defining a width direction, and a length defined between a third edge and a fourth edge and defining a length direction;

a plurality of interconnected web members within the body, wherein a first interconnected web member is joined to a second interconnected web member at a first node, and a third interconnected web member is joined to the second interconnected web member at a second node; and a first fortifying member positioned at the first node and a second fortifying member is positioned at the second node, wherein the first fortifying member and the second fortifying member are enlarged with respect to the first, second and third interconnected web members, and wherein the first fortifying member and the second fortifying member each extend within the body in a direction substantially perpendicular to both of the length direction and the width direction, wherein the body, the plurality of interconnected web members, the first fortifying member, and the second fortifying member are integrally formed to define an integrally formed mat.

15. The mat of claim 14, wherein at least one interconnected web member comprises a taper in a direction substantially perpendicular to both of the length direction and the width direction.

16. The mat of claim 14, further comprising a third fortifying member integrally formed within one interconnected web member at a location between the first node and the second node.

17. The mat of claim 14 wherein the first fortifying member is integrally formed with a first side of the mat and aligns with a third fortifying member integrally formed with a second side of the mat.

18. The mat of claim 17 further comprising:

a lip extending from the body, the lip having a thickness less than a thickness of the mat; and a plurality of ribs forming the lip, the plurality of ribs forming an undulating surface with a plurality of voids formed between the plurality of ribs at a plurality of channels formed between the plurality of ribs.

19. The mat of claim 18, wherein the ribs of the plurality of ribs have varying thicknesses.

20. A mat comprising:

a body having a width defined between a first edge and a second edge and defining a width direction, and a length defined between a third edge and a fourth edge and defining a length direction;

a plurality of interconnected web members within the body, wherein a first interconnected web member is joined to a second interconnected web member at a first node, and a third interconnected web member is joined to the second interconnected web member at a second node;

a first fortifying member positioned at the first node and a second fortifying member is positioned at the second node;

a lip extending from the body, the lip having a thickness less than a thickness of the mat; and a plurality of ribs forming the lip, the plurality of ribs forming an undulating surface with a plurality of voids formed between the plurality of ribs at a plurality of channels formed between the plurality of ribs, wherein the first fortifying member and the second fortifying member are enlarged with respect to the first, second and third interconnected web members, and wherein the first fortifying member and the second fortifying member each extend within the body in a direction substantially perpendicular to both of the length direction and the width direction.

* * * * *